US005401565A

United States Patent [19]

Vouette

[11] Patent Number: 5,401,565

[45] Date of Patent: Mar. 28, 1995

[54] METHOD OF MANUFACTURING A BI-REACTIVE HEAT BONDING TEXTILE PRODUCT AND THE RESULTANT PRODUCT

[75] Inventor: Marie-Helene Vouette, Courbevoie, France

[73] Assignee: Lainiere De Picardie, Peronne, France

[21] Appl. No.: 222,338

[22] Filed: Apr. 4, 1994

Related U.S. Application Data

[63] Continuation of Ser. No. 962,007, Oct. 15, 1992, abandoned, which is a continuation of Ser. No. 414,001, Sep. 28, 1989, abandoned.

[30] Foreign Application Priority Data

Sep. 28, 1988 [FR] France ..... 88 12673

[51] Int. Cl.[6] ..... C09J 7/02

[52] U.S. Cl. ..... 428/261; 428/343; 428/345; 428/349; 428/355

[58] Field of Search ..... 428/198, 261, 343, 345, 428/349, 355, 423.1

[56] References Cited

U.S. PATENT DOCUMENTS

| | | | |
|---|---|---|---|
| 3,922,418 | 11/1975 | Lauchenauer | 428/198 |
| 3,937,859 | 2/1976 | Carra | 428/355 |
| 4,110,286 | 8/1978 | Vandegaer | 524/874 |
| 4,438,533 | 3/1984 | Hefele | 428/198 |
| 4,649,077 | 3/1987 | Lauchenauer | 428/349 |
| 4,874,655 | 10/1989 | Groshens | 428/198 |

*Primary Examiner*—Jenna L. Davis

*Attorney, Agent, or Firm*—Popham, Haik, Schnobrich & Kaufman, Ltd.

[57] ABSTRACT

The invention relates to heat-bonding products in which a heat-adhesive layer is applied to a textile support. The heat-adhesive layer comprises cross-linkable polymers including initially at least two reactive and/or reactivable functions, the first of these functions is activated at the time of depositing the heat-adhesive layer on the support. A second reactive and/or reactivable function is activated during application of the heat-adhesive layer to the textile support.

3 Claims, No Drawings

METHOD OF MANUFACTURING A BI-REACTIVE HEAT BONDING TEXTILE PRODUCT AND THE RESULTANT PRODUCT

This application is a file wrapper continuation of U.S. patent application Ser. No. 07/962,007, filed Oct. 15, 1992, now abandoned which is a continuation of 07/414,001, filed Sep. 28, 1989, now abandoned.

The invention relates to heat-bonding textile products. These are products comprising a textile support on which a layer of heat-bonding polymers is applied.

Generally, these products must be stored after the textile support has received the polymer layer and they are intended, by the effect of the variation of an external parameter, particularly the temperature, to become bonding, thus permitting adhesion thereof to another fabric.

Heat-bonding products are now widely used in the textile industry for example as reinforcement fabrics, their application on linings or on curtaining making it possible to modify the characteristics of the fabrics, improving their resistance and preservation of their qualities. The textile supports used are very varied. They may be woven, knitted or non woven.

The methods of applying the heat-adhesive layer on its support are numerous. For many uses, application by spots maintaining a great flexibility of the fabrics is preferred whereas, for other uses, a continuous adhesive layer is better for attaining the desired properties.

In the case of reinforcement fabrics, the textile support is coated with the heat-bonding substance. At the present time such coating is by spots using an engraved cylinder. The heat-bonding polymers, initially in the form of a powder or a paste, are brought to a temperature which causes them to melt and adhere to the support. In another technique, coating is by transfer, i.e. the heat-bonding polymers are deposited in the form of spots by an engraved cylinder on a belt treated so as to be non adhesive; these spots are then transferred at a lower temperature to the textile support.

The heat-bonding textile product thus obtained is then stored at ambient temperature. It is then necessary for the different layers of this product, in contact, not to adhere to each other. That is to say the heat-bonding textile product must not present any "tack". Thus, close to ambient temperature, the textile products used must not be sticky, i.e. not have any immediate adherence.

The heat-bonding textile product is then used by ready-made clothiers who apply it against other fabrics, curtaining or linings and thus cause the reinforcement fabric to stick to the curtaining by means of a press at pressures of a few decibars to a few bars for relatively short times of the order of 10 to 30 seconds and at temperatures generally greater than 100° C. During this phase, the polymers of the heat-bonding textile product must recover their adhesive property. However, they must not have too low a viscosity for too long a time during this operation for, otherwise, the polymer will pass through the textile support or curtaining itself causing twisting at such penetration positions which makes the products obtained unattractive and often unusable.

Finally, the finished clothes and so in particular the curtaining or linings provided with the reinforcement fabric must withstand the different modes of use, washing, ironing, . . . The bonding provided in the preceding step must therefore withstand difficult ambient conditions.

Numerous attempts have been made to produce products well adapted to the different constraints resulting from the above mentioned set of phases.

Thus, it has been proposed for example to provide an adhesive formed of two or more layers of polymers having different physical characteristics. By suitably choosing the viscosity and melting temperature of these different layers, the penetration or twisting may thus be limited. However, the use of this technique is very delicate.

The method of depositing the heat-bonding material on the textile substrate by transfer, mentioned above, avoids excessive penetration of the heat-bonding material into the textile substrate.

It has also been proposed to deposit a heat-bonding polymer on the textile substrate and to make it heat hardenable by the action of a cross-linking agent subsequently placed in contact therewith.

The aim of the present invention is a method of manufacturing a heat-bonding textile product and the resultant product. This product can be used in particular as reinforcement fabric. Such reinforcement fabrics must be able to be readily bonded, without twisting or excessive penetration and they must in particular withstand the agents and processes used for cleaning clothes and ironing.

For this, the method of manufacturing a heat-bonding product in accordance with the invention is of the type in which a heat adhesive layer is applied to a textile support, said layer comprising polymers having a reactive and/or reactivable function permitting adhesion of the product for example to curtaining or linings.

In this method, the heat-adhesive product comprises a first reactive and/or reactivable function which is activated when the heat-adhesive layer is applied to the textile support.

The heat-bonding product of the invention is of the type comprising a textile support and a heat-adhesive layer deposited on its surface, this heat-adhesive layer comprising cross-linkable polymers having initially at least two reactive and/or reactivable functions, the first of these functions having been activated during depositing of the heat-adhesive on the support.

The invention will be better understood from the following description and embodiments which accompany it.

Whereas the different improvements made up to now to the manufacture of heat-bonding products, the closest to the invention, use polymers having reactive and/or reactivable functions in a single step, it has become surprisingly apparent that the production of a product satisfying the above mentioned constraints could advantageously be obtained by using an adhesive comprising two distinct reactive and/or reactivable functions.

By distinct functions is meant here the fact that the first of the functions may be activated under conditions which do not influence the second function and in particular do not activate it. Thus, it is possible to cross-link this adhesive in two separate steps and at different freely determined times. It may also be a single chemical function, partially activated because of the relative dose of the cross-linking agent used during the first step.

The activation conditions may be humidity, temperature, ambient pressure conditions, and may also be any other value of these parameters, the action of electromagnetic radiation such as ultraviolet, high frequency radiation, the action of chemical agents, electron bombardment or else any combination of these parameters.

The essential condition to be respected being that, by application of this ambience, the second reactive function is maintained in its initial state.

This second reactive function may then be activated similarly to the activation of the first function under conditions whose influence on the first function has of course no importance, since this first function has already been activated.

The heat-adhesive layer comprising polymers having these two distinct reactive and/or reactivable functions is called bi-reactive heat-adhesive layer.

The thermoadhesive which forms it may either comprise a mixture of two polymers each of which comprises one of the reactive functions, it may also comprise a single polymer whose chain comprises at least two types of function reacting under different conditions depending on the modes of use mentioned above.

The method of manufacturing the heat-bonding product of the invention comprises a first phase in which the heat-adhesive layer is applied to a textile support. It is applicable to any type of textile support (woven, knitted, non woven, . . . ).

Such application may be made by numerous means known to a man skilled in the art; by coating (rotary or flat frame), by spraying, by sprinkling. Such application may consist either of a continuous layer or preferably a spot distribution, such geometric distribution being calibrated conventionally in a way known per se.

During such application, the first reactive and/or reactivable function of the heat-bonding layer is activated.

That may be obtained by using a two-component heat-adhesive in which a cross-linking agent is incorporated in the heat-adhesive before its application. Such cross-linking agent then causes, for example under the usual conditions of application (temperature, pressure, humidity), the polymerization by activation of the first function.

Activation of the first function may also be obtained in the case of a two-component system as in the case of a single component by a rise in temperature, pressure or else high frequency radiation, during or after application.

The simultaneity with the first activation is therefore approximate, the latter being announced a little before, during or after the moment of application but still in the same phase of manufacture before storing of the product is necessary.

Following this first polymerization, the product under ordinary storage conditions has no "tack", i.e. the different layers of heat-bonding product in contact with each other do not adhere.

The heat-bonding product obtained by this method may then be applied to any other textile product, lining, stiffening or curtaining, by application of adapted physical conditions (temperature, pressure, . . . ).It is made less viscous which makes adhesion possible. The second reactive and/or reactivable function is then activated causing cross-linking of the thermoadhesive and providing stability.

Both the reactive and/or reactivable functions may be activated by contacting cross-linkable polymers with a cross-linking agent. Throughout the whole of this text by cross-linking agent is meant either a cross-linking agent certain functions of which participate in the final product or a catalyst, namely a component which will be found again entirely in its initial condition at the end of the reaction.

The first reactive function may be reactivable by the action of an unblocked cross-linking agent with which the heat-bonding polymer is placed in contact before application to the textile support. The second reactive function on the other hand being reactivable by a blocked cross-linking agent which will be activated during application of the heat-bonding product to the lining, stiffening or curtaining on the users premises. Such activation may be obtained by varying the pressure, temperature parameters, by the effect of electromagnetic radiation such as ultraviolet, high frequency radiation, or by an external chemical agent effect or by any combination of these actions.

In a preferred embodiment, the first reactive function is initially also blocked. It is activatable during application of the polymers to their textile support by the effect of a variation of the pressure or the temperature or else by the effect of ultraviolet radiation or high frequency radiation or else by any combination of these parameters. In order to provide different activation conditions of the second function, it will be activatable, during bonding of the heat-bonding product for example to lining or curtaining by the variation or by the effect of a parameter different from that having activated the first function or by variation of the same parameter or of the same combination of these parameters at a different level.

The polymers of the heat-adhesive layer applied to the textile support for producing the heat-bonding product of course comprise other elements than the chemical cross-linking functions alone mentioned above. They comprise in particular polymer chains whose nature and functionalities come into play for determining the viscosity and adhesion of the heat-bonding agent in combination with the above mentioned cross-linkable polymers.

The adhesive layer may also comprise neutral charges, stabilizers, dyes, . . .

In a preferred embodiment of the invention, the heat-bonding layer is a two-component system comprising a resin and a hardener. The resin contains polyols and/or epoxies as well blocked isocyanates. The hardener comprises unblocked isocyanates which mixed with the resin causes a first cross-linking giving a first polyurethane system.

The second cross-linking is generated during unblocking of the blocked isocyanate which, by action on the alcohol functions remaining free, then gives rise to a second polyurethane system.

The unblocking temperature depends on the blocking agent. The latter may be formed of oxides, oxamates, diketones, capralacatames, triasoles, imidazolenes, phenols, . . .

Without departing from the scope of the invention, a man skilled in the art may, from general knowledge concerning polymers, obtain numerous products.

Thus, the one or two component epoxy resins cross-link at ambient temperature or by the effect of the temperature.

Acrylic based mixtures are photo cross-linkable, others are sensitive to heat.

Unsaturated polyester based mixtures are also photo cross-linkable or heat cross-linkable.

Encapsulated aziridines permit cross-linking of polyamides.

Before their application on the support, these heat-adhesive products are in the form of more or less viscous powders or pastes.

The use of such polymers whose properties are well known makes it possible to obtain a range of products in accordance with the object of the invention and which can be obtained using its method, having properties in the different stages of the method making it possible to satisfy any type of original product (reinforcement fabric and fabric on which the bonding is carried out, lining or curtaining) and to obtain products once bonded having the desired properties (flexibility, feel, volume, cleaning, . . . ).

A particular embodiment is the following:

The heat-adhesive layer comprises a resin, free isocyanates and blocked isocyanates.

The resin contains hydroxylated polybutadiene and a diol playing the role of chain activator.

The free isocyanate is IPDI (3 isocyanatomethyl-3,5,5-trimethylcyclohesyl isocyanate).

The blocked isocyanate is a TDI isocyanate toluene blocked by paranitrophenol (unblocking temperature=14°).

Once the heat-bonding layer is deposited on the textile base, a first baking at 60° C. activates the first reactive function.

The free isocyanate reacts with the resin to give weakly cross-linked polyurethane dry at ambient temperature.

During bonding, second baking at 140° C. (half an hour) re-fluidifies the adhesive which makes possible adhesion to the curtaining at the same time as the paranitrophenol blocked isocyanate is released for reacting with the remaining hydroxyl functions. Then a highly cross-linked polyurethane network is obtained.

The following table gives the functionalities and proportions of the resin:

| COMPONENTS | FUNCTIONALITY | PARTS BY WEIGHT |
|---|---|---|
| POLYBUTADIENE HYDROXYL | Between 0.75 and 0.85 OH/kg preferably 0.08 OH/kg | about 100 |
| DIOL | Between 10 and 20 OH/kg preferably 15 OH/kg | about 10 |
| IPDI | Between 4 and 10 NCO/kg preferably 8 NCO/kg | about 20 |
| TDI | Between 5 and 15 NCO/kg preferably 10 NCO/kg | about 10 |

This example forms a particular embodiment. From the teaching of the present description, numerous other embodiments are conceivable without departing from the scope of the invention.

It is claimed:

1. A heat-bonding product comprising:

a textile support having at least one surface; and a single heat-adhesive layer deposited upon a surface of said support;

wherein said heat-adhesive layer comprises a hydroxylated polybutadiene and a diol as a chain activator, an isocyanate having free isocyanate groups, and an isocyantate having isocyanate groups blocked by a blocking agent; the free isocyanate groups reacting with the hydroxylated polybutadiene under substantially different conditions than said blocked isocyanate groups.

2. A heat-bonding product according to claim 1 and, wherein:

said blocked isocyanate is activated under conditions selected from the group consisting of pressure, temperature, exposure electromagnetic radiation, exposure to a chemical agent, exposure to electro-bombardment, and a combination thereof.

3. A heat-bonding product according to claim 2, wherein:

the blocking agent for said blocked isocyanate is selected from the group consisting of oximes, oxamates, and diketones.

* * * * *